US009334732B2

(12) United States Patent
Lachmann et al.

(10) Patent No.: US 9,334,732 B2
(45) Date of Patent: May 10, 2016

(54) PICK TOOL ASSEMBLY AND METHOD OF USING SAME

(71) Applicant: ELEMENT SIX GMBH, Burghaun (DE)

(72) Inventors: Frank Friedrich Lachmann, Burghaun (DE); Bernd Heinrich Ries, Burghaun (DE)

(73) Assignee: Element Six GmbH, Burghaun (DE)

( * ) Notice: Subject to any disclaimer, the term of this patent is extended or adjusted under 35 U.S.C. 154(b) by 0 days.

(21) Appl. No.: 14/435,185

(22) PCT Filed: Nov. 6, 2013

(86) PCT No.: PCT/EP2013/073172

§ 371 (c)(1),
(2) Date: Apr. 13, 2015

(87) PCT Pub. No.: WO2014/072345

PCT Pub. Date: May 15, 2014

(65) Prior Publication Data

US 2015/0267535 A1 Sep. 24, 2015

Related U.S. Application Data

(60) Provisional application No. 61/725,097, filed on Nov. 12, 2012.

(30) Foreign Application Priority Data

Nov. 12, 2012 (GB) ..... 1220294.1

(51) Int. Cl.
*E21C 35/193* (2006.01)
*E21C 35/19* (2006.01)

(Continued)

(52) U.S. Cl.
CPC ..... *E21C 35/19* (2013.01); *E21C 35/183* (2013.01); *E21C 35/1933* (2013.01); *E21C 2035/182* (2013.01); *E21C 2035/1806* (2013.01)

(58) Field of Classification Search
CPC ..... E21C 2035/182; E21C 35/193; E21C 35/1933; E21C 35/1936
USPC ..... 299/101, 102, 103, 111
See application file for complete search history.

(56) References Cited

U.S. PATENT DOCUMENTS 2,610,049 A 9/1952 Elles et al.
2,853,283 A 9/1958 Cook (Continued)

FOREIGN PATENT DOCUMENTS

DE 1029771 B 5/1958
GB 1486549 A 9/1997

(Continued)

OTHER PUBLICATIONS

B-12-02844 Rock Razor Brochure.

(Continued)

*Primary Examiner* — David Bagnell
*Assistant Examiner* — Michael Goodwin
(74) *Attorney, Agent, or Firm* — Dean W. Russell; Clark F. Weight; Kilpatrick Townsend & Stockton LLP

(57) ABSTRACT

A pick tool assembly (100) comprises a strike tip (210), a holder (230) and a reversible attachment mechanism 245, 350) for coupling the strike tip (210) to the holder (230), in which the strike tip (210) comprises a strike surface including an apex. The pick tool assembly (100) will be configured such that the strike tip (210) can be non-moveably coupled to the holder (230) in a plurality of mutually opposite orientations relative to the holder, the orientations being about a symmetry axis (L) through the apex. The attachment mechanism will limit the opposite orientations (245-*ii*, 245-*ii*) to being at least about 160 degrees azimuthally apart, and be configured such that the strike tip (210) may be coupled to the holder assembly (230) in either of two and only two mutually opposite orientations.

16 Claims, 6 Drawing Sheets

(51) Int. Cl.
*E21C 35/183* (2006.01)
*E21C 35/18* (2006.01)

(56) References Cited

U.S. PATENT DOCUMENTS

| | | | | |
|---|---|---|---|---|
| 4,193,638 | A * | 3/1980 | Heckenhauer | 299/101 |
| 4,607,891 | A | 8/1986 | Pendolino et al. | |
| 4,753,678 | A * | 6/1988 | Maruyama et al. | 75/238 |
| 5,007,685 | A * | 4/1991 | Beach et al. | 299/85.2 |
| 5,453,105 | A | 9/1995 | Middlemiss et al. | |
| 6,099,081 | A * | 8/2000 | Warren et al. | 299/104 |
| 6,179,886 | B1 | 1/2001 | Gordeev et al. | |
| 6,447,852 | B1 | 9/2002 | Gordeev et al. | |
| 6,709,747 | B1 | 3/2004 | Gordeev et al. | |
| 6,919,040 | B2 | 7/2005 | Fries et al. | |
| 7,008,672 | B2 | 3/2006 | Gordeev et al. | |
| 7,669,938 | B2 * | 3/2010 | Hall et al. | 299/111 |
| 8,534,766 | B2 * | 9/2013 | Ritchey et al. | 299/106 |
| 8,596,387 | B1 * | 12/2013 | Sani et al. | 175/433 |
| 2009/0200855 | A1 | 8/2009 | Hall et al. | |
| 2009/0200857 | A1 | 8/2009 | Hall et al. | |
| 2009/0261646 | A1 | 10/2009 | Ritchey et al. | |
| 2011/0175430 | A1 * | 7/2011 | Heiderich et al. | 299/105 |

FOREIGN PATENT DOCUMENTS

| | | | |
|---|---|---|---|
| WO | 2009013713 | A2 | 1/2009 |
| WO | 2011004030 | A2 | 1/2011 |

OTHER PUBLICATIONS

International Search Report for PCT/EP2013/073172 dated Feb. 5, 2014.
Search Report for GB1220294.1 dated Apr. 30, 2013.
Search Report for GB1319596.1 dated Apr. 30, 2014.

* cited by examiner

PICK TOOL ASSEMBLY AND METHOD OF USING SAME

CROSS REFERENCE TO RELATED APPLICATIONS

This application is the U.S. national phase of International Application No. PCT/EP2013/073172 filed on Nov. 6, 2013, and published in English on May 15, 2014 as International Publication No. WO 2014/072345 A1, which application claims priority to Great Britain Patent Application No. 1220294.1 filed on Nov. 12, 2012, and U.S. Provisional Application No. 61/725,097 filed on Nov. 12, 2012, the contents of all of which are incorporated herein by reference.

This disclosure relates generally to pick tool assemblies, particularly but not exclusively comprising super-hard strike tips and for use in the degradation of rock or pavement.

International patent application publication number WO2011/004030 discloses an attack tool assembly comprising an attack tool having a shank extending therefrom, the shank having a longitudinal axis; and a holder having a bore for receiving the shank of the attack tool. The holder is adapted to receive the shank in a configuration in which it prevents the shank from rotating relative to the bore when the holder is in an engaged condition, and in which it allows the shank to be rotatable relative to the bore when the holder is in a disengaged condition, so as to enable the shank to be selectively securable to the holder in a required orientation about the longitudinal axis.

There is a need to provide a super-hard attack tool assembly having enhanced working life.

Viewed from a first aspect there is provided a pick tool assembly (configured for attachment to a drive apparatus), comprising a strike tip (for striking a body to be degraded), a holder and a reversible attachment mechanism for coupling the strike tip to the holder, in which the strike tip comprises a strike surface including an apex; configured such that the strike tip can be non-moveably coupled to the holder in a plurality of mutually opposite orientations relative to the holder, the orientations being about a symmetry axis through the apex, the attachment mechanism limiting the opposite orientations to being at least about 160 degrees, at least about 170 degrees or at least about 175 degrees, or to substantially 180 degrees azimuthally apart (in a plane perpendicular to the symmetry axis), and configured such that the strike tip may be coupled to the holder assembly in either of two and only two mutually opposite orientations. In other words, the attachment mechanism will be configured such that the strike tip will be prevented from being capable of being coupled to the holder assembly in any orientation other that one of two mutually opposite orientations. The pick tool assembly may be in an assembled or unassembled condition.

Various arrangements and combinations for pick tool assemblies are envisaged by this disclosure, of which the following are non-exhaustive and non-limiting examples, which may be used in combination with one or more of each other in some example arrangements.

In some example arrangements, the opposite orientations may be at least about 170 degrees or at least about 175 degrees, and at most about 190 degrees or at most about 185 degrees azimuthally spaced apart, or the orientations may be limited to a single pair of diametrically opposite orientations (i.e. on opposite sides of the apex, along a line through the symmetry axis).

In some example arrangements, the pick tool assembly may comprise a limit mechanism capable of preventing coupling of the strike tip to the holder assembly in any orientation other than within two and only opposite orientation ranges, each limit of each orientation range being at least about 160 degrees, at least about 170 degrees or at least about 185 degrees azimuthally apart from a corresponding limit of the other orientation range.

In some example arrangements, each of two opposite ranges of orientations may have an (azimuthal) angle width of up to about 40 degrees, about 20 degrees or about 10 degrees between the limits of the respective range. In other words, each range may permit the strike structure to be attached to the holder assembly in an orientation selected within limits azimuthally spaced apart in the plane of orientation by 40 degrees, 20 degrees or 10 degrees. The azimuthal width of the two ranges of orientations may be substantially the same or they may be different.

The pick tool assembly may be for road milling and or mining. In some example arrangements, the pick tool assembly may comprise the drive apparatus, in which the holder can be non-moveably coupled to the drive apparatus. The drive apparatus may comprise a drum to which a plurality of pick tools can be attached. In some example arrangements, the pick tool assembly and the means by which the holder can be attached to the drive apparatus may be configured such that the strike tip will be prevented from substantially moving in use relative to the drive apparatus, for example a drum for road milling or mining.

In some example arrangements, the pick tool assembly may comprise super-hard material coterminous with the strike surface. In some examples, the super-hard material may comprise or consist of polycrystalline diamond (PCD) material, polycrystalline cubic boron nitride (PCBN) material or silicon carbide bonded diamond (SCD) material.

In some example arrangements, the strike surface may include a conical surface at least partly surrounding the apex. The conical surface may extend from the apex to a peripheral side of the strike tip.

In some example arrangements, the strike tip may have at least two-fold symmetry corresponding to the opposite orientations. In other words, the strike tip may be configured such that it can present substantially the same geometrical shape when in each of the orientations about the symmetry axis, from the perspective of a body to be struck in use. The strike tip may have substantially cylindrical symmetry about the symmetry axis, such that the strike surface will appear substantially the same for any rotation of the strike tip about the symmetry axis.

In some example arrangements, the apex may be in the form of a rounded cone point or a rounded elongate ridge (some such example strike tips may be described as chisel-like). In some examples, the strike surface may include at least a pair of opposite flat surface areas extending from the apex. The apex may define a radius of curvature in a longitudinal plane extending through the apex and the distal end of the strike tip opposite the apex, parallel to the symmetry axis. In various examples, the radius of curvature of the apex may be at least about 1 millimeter, at least about 2 millimeters or at least about 3 millimeters, and or in various examples the radius of curvature of the apex may be at most about 4 millimeters or at most about 6 millimeters. The strike tip may comprise a substrate to which the strike structure is joined at a non-planar boundary.

In some example arrangements, the strike tip may comprise a strike structure comprising or consisting of super-hard material joined to a substrate. The substrate may comprise cobalt-cemented tungsten carbide. In some examples, the super-hard material may be formed joined to the substrate, by which is mean that the super-hard material is produced (for example sintered) in the same general step in which the super-hard structure becomes joined to the substrate. The substrate may comprise cemented tungsten carbide material including at least about 5 weight percent and at most about 10 weight percent or at most about 8 weight percent binder material, which may comprise cobalt (as measured prior to subjecting the substrate to any high-pressure, high temperature condition at which the super-hard structure may be produced; the actual binder content after such treatment is likely to be somewhat lower). The cemented carbide material may have Rockwell hardness of at least about 88 HRa (Rockwell hardness scale A); transverse rupture strength of at least about 2,500 MPa (megapascals); and or magnetic saturation of at least about 8 G·cm3/g (Gauss times cubic centimeter per gram) and at most about 16 G·cm3/g (Gauss times cubic centimeter per gram) or at most about 13 G·cm3/g (Gauss times cubic centimeter per gram) and coercivity of at least about 6 kA/m (kiloamperes per meter) and at most about 14 kA/m (kiloamperes per meter). Cemented carbide material having relatively low binder content is likely to provide enhanced stiffness and support for the tip in use, which may help reduce the risk of fracture, and is likely to exhibit good wear resistance.

In some example arrangements, the pick tool assembly may comprise a strike assembly and a holder assembly, the strike assembly comprising the strike tip and a coupler member; the holder assembly comprising a holder member for accommodating the coupler member and a securement member for reversibly securing the coupler member to the holder member; the attachment mechanism comprising the coupler member, holder member and securement member, cooperatively configured for non-moveably coupling the strike tip to the holder member in the plurality of mutually opposite orientations. The strike assembly and or the holder assembly may comprise a plurality of components that are capable of being disassembled or the strike assembly and or the holder assembly may consist of a single unitary part.

In some example arrangements, the coupler member may be configured for insertion into a bore provided in the holder member, the coupler member and the holder member being cooperatively configured such that the coupler member can be accommodated by the bore and the securement member can reversibly engage the coupler member, operative to secure and to release the coupler member within the bore.

In some example arrangements, the coupler member may be configured such that the securement member cannot engage the coupler member with sufficient force to prevent rotation of the coupler member within the bore when in use, when the coupler member is oriented within the bore other than at one of a plurality of mutually opposite orientations relative to the holder, the orientations being about a longitudinal symmetry axis of the coupler and at least about 160 degrees azimuthally apart. In other words, it will not be possible to secure the coupler member within the bore at any pair of orientations (with respect to the holder) that are less than about 160 degrees azimuthally apart.

In some example arrangements, the coupler member may comprise a cylindrical side surface and the holder member comprises a bore for accommodating the coupler member; the coupler member comprising a pair of engagement surfaces on opposite sides of the side surface, the coupler member and holder assembly cooperatively configured such that the securement member can impinge on either of the flat surfaces when the coupler member is inserted in the bore, and secure the coupler member within the bore.

In some example arrangements, the holder assembly may include a securement member for securing the strike assembly to the holder assembly and the strike assembly may comprise a coupler member, which can be engaged by the securement member when the strike assembly is non-moveably attached to the holder assembly. The securement member may engage, for example abut, the coupler member when the pick assembly is in an engaged condition, in which the intermediate holder is non-moveably attached to the holder assembly, and the securement member may be spaced apart from the coupler member when the pick assembly is in a disengaged condition, in which the strike tip can be moved relative to the holder assembly, for example to change its orientation within the holder assembly.

In some example arrangements, the holder assembly may comprise a holder member provided with a bore for accommodating the coupler member of the strike tip, and a securement member capable of protruding into the bore through an aperture extending from an inner surface of the bore to an outer surface of the holder member. The securement member may be displaceable between an engaged position, in which an end of the securement member abuts the coupler member, and a retracted position, in which the end of the securement member is spaced apart from the coupler member.

In some example arrangements, the securement member may comprise a set screw accommodated by a threaded aperture provided in the holder member. The engagement surfaces may be substantially flat.

In some example arrangements, the strike assembly may comprise an intermediate holder and a support body; the support body comprising a shaft extending away from an end of the support body to which the strike tip can be joined; the intermediate holder comprising a bore for accommodating the shaft and comprising the coupler member; the shaft and the bore being cooperatively configured such that the shaft can be secured within the bore by means of an interference fit, such as a shrink or press fit. The bore and the coupler member may be at opposite ends of the intermediate holder. The strike tip may be joined to the end of the support body by means of braze material. The support body may comprise or consist of cemented carbide material, which may be of a different grade and may be substantially harder and more abrasion resistant than that comprised or consisting in the substrate.

In some example arrangements, the support body and the intermediate holder may be configured such that the support body will shield an external surface area of the intermediate holder in use. The support body may comprise a head portion from which the shaft extends, configured such that the head portion abuts a proximate end surface of the intermediate holder surrounding the bore when the shaft is secured within the bore. The head portion may comprise a conical side surface extending away from a flat end surface to which the strike tip is attached, and a base surface opposite the conical surface, the base surface extending over an external surface area of the intermediate holder when the shaft of the support body is inserted into the bore of the intermediate holder.

In some examples, the support body may comprise cemented tungsten carbide, ceramic material, silicon carbide cemented diamond material or super-hard material, and the intermediate holder may comprise steel. The support material may have Rockwell hardness of at least about 90 HRa (Rockwell hardness scale A) and transverse rupture strength of at least about 2,500 MPa (megapascals). For example, the support body may comprise or consist of cemented tungsten carbide material having magnetic saturation of at least about 7 G·cm3/g (Gauss times cubic centimeter per gram) and at most about 11 G·cm3/g (Gauss times cubic centimeter per gram) and coercivity of at least about 9 kA/m (kiloamperes per meter) and at most about 14 kA/m (kiloamperes per meter). The support body may comprise or consist of cemented carbide material, which may comprise tungsten carbide grains and at least about 5 weight percent and at most about 10 weight percent or at most about 8 weight per cent binder material, which may comprise cobalt. The tungsten carbide grains having a mean size of at most about 6 microns, at most about 5 microns or at most about 3 microns. The mean size of the tungsten carbide grains may be at least about 1 micron or at least about 2 microns.

Viewed from a second aspect, there is provided a method of using a pick tool assembly according to this disclosure, the method including providing a pick tool assembly in an assembled condition and mounted onto a drive apparatus, in which the strike structure is arranged in a first orientation relative to the holder assembly; fragmenting a body or a plurality of bodies by repeatedly striking the strike structure against the body or bodies; changing the orientation of the strike structure such that it is arranged in a second orientation relative to the holder assembly, the second orientation being at least about 160 degrees, at least about 170 degrees or at least about 175 degrees azimuthally from the first orientation, and further fragmenting a body or a plurality of bodies by repeatedly striking the strike structure against the body or bodies.

In some examples, the body or plurality of bodies may comprise road pavement, which may comprise asphalt or concrete for example, and or a rock formation, which may comprise coal or potash for example.

In some examples, the second orientation may be at least about 170 degrees and at most about 190 degrees azimuthally apart from the first orientation, or the first and second orientations may be in opposite directions.

In some examples, the method may include striking the body or bodies a first number of strikes when the strike structure is in the first orientation and striking a body or bodies a second number of strikes when the strike structure is in the second orientation, in which the second number of strikes is at least about 50 percent, at least about 80 percent of first number of strikes, or the second number of strikes may be at least the same as the first number of strikes.

Non-limiting example arrangements will now be described with reference to the accompanying drawings, of which:

Figure 1A:
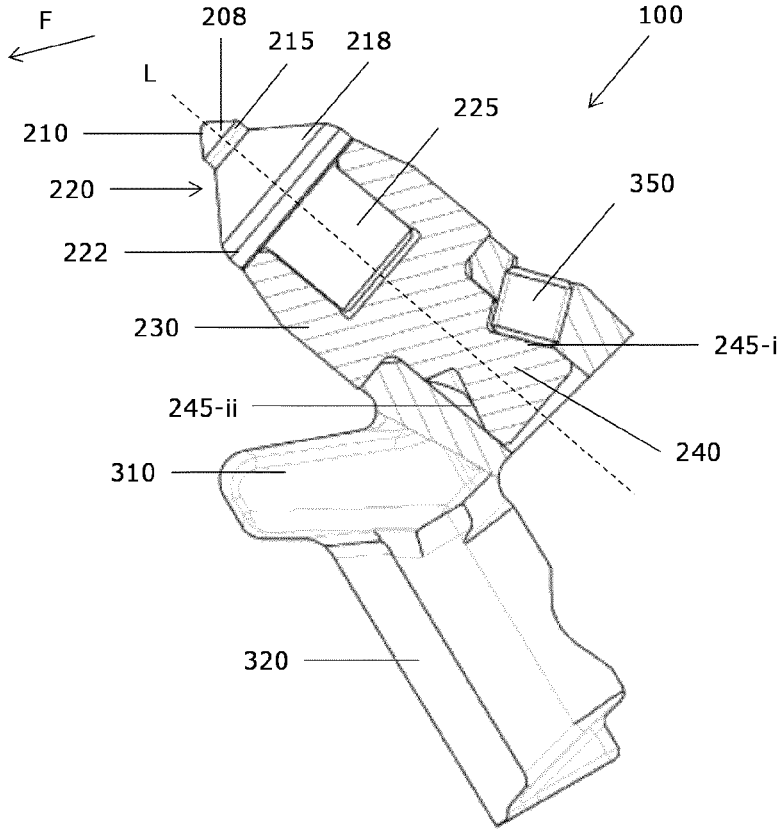
FIG. 1A shows a schematic partly cut-away side view of an example pick tool assembly.
Figure 1B:
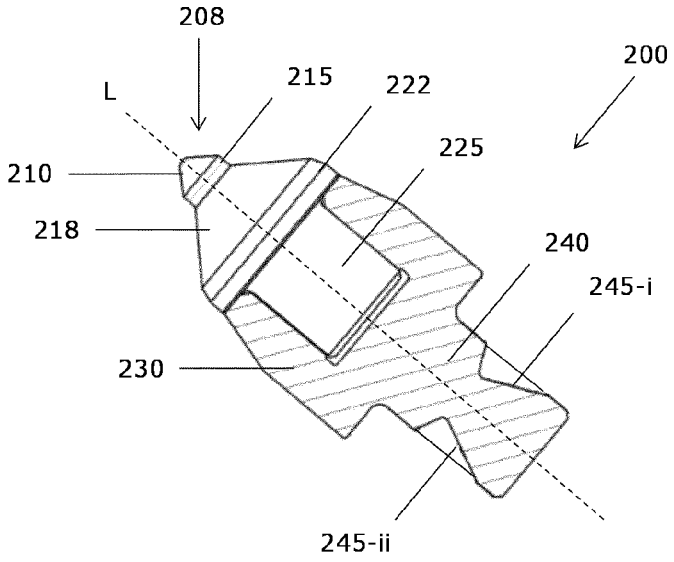
FIG. 1B shows a schematic partly cut-away side view of an example strike assembly.
Figure 1C:
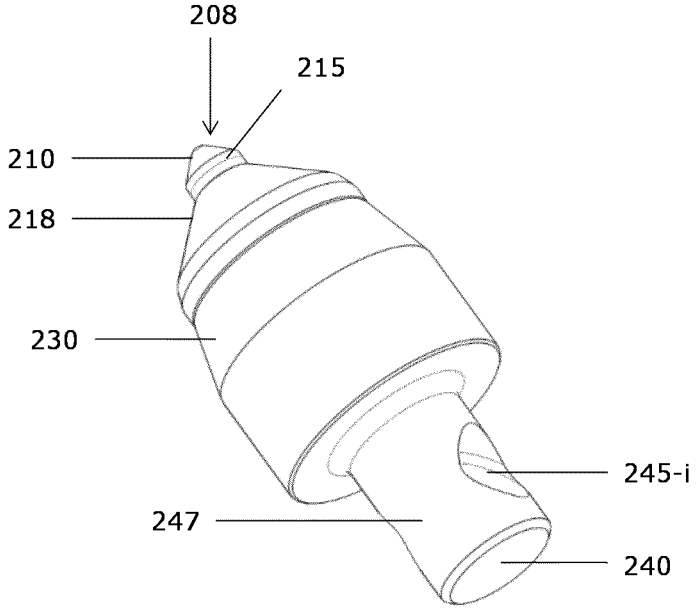
FIG. 1C shows a schematic perspective view of an example strike assembly.
Figure 1D:
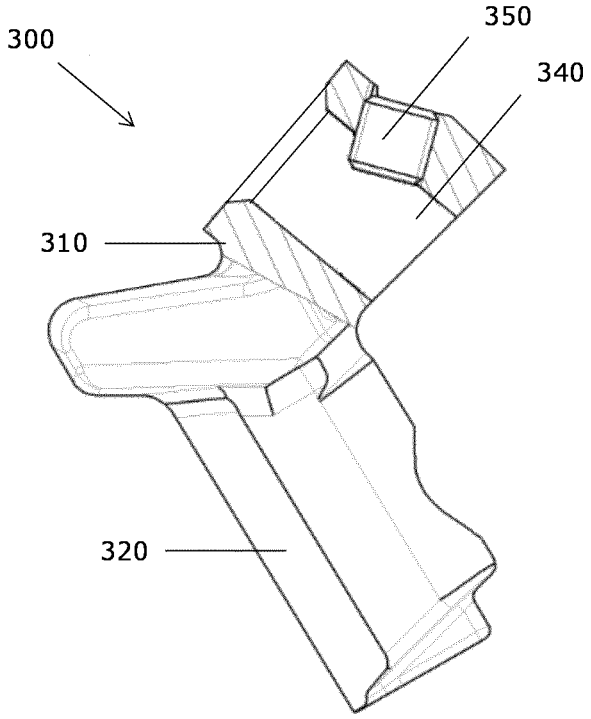
FIG. 1D shows a schematic partly cut-away side view of an example holder assembly.
Figure 1E:
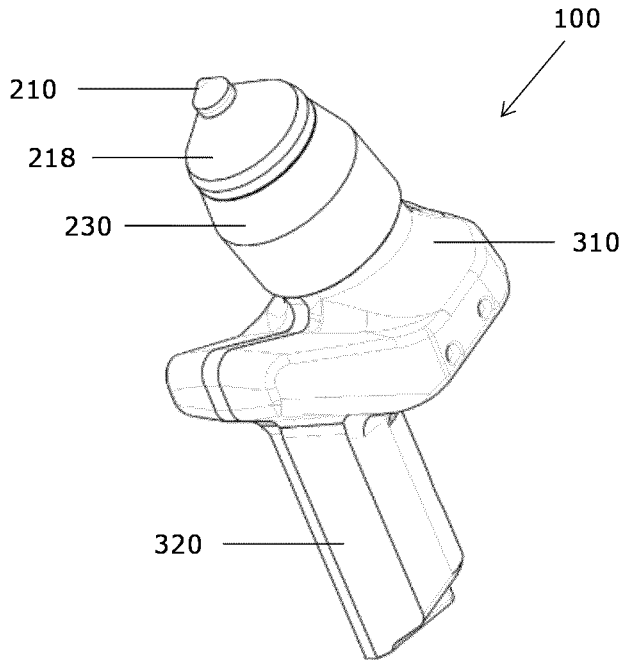
FIG. 1E shows a schematic perspective view of the example pick tool assembly shown in FIG. 1A, in the assembled condition.
Figure 1F:
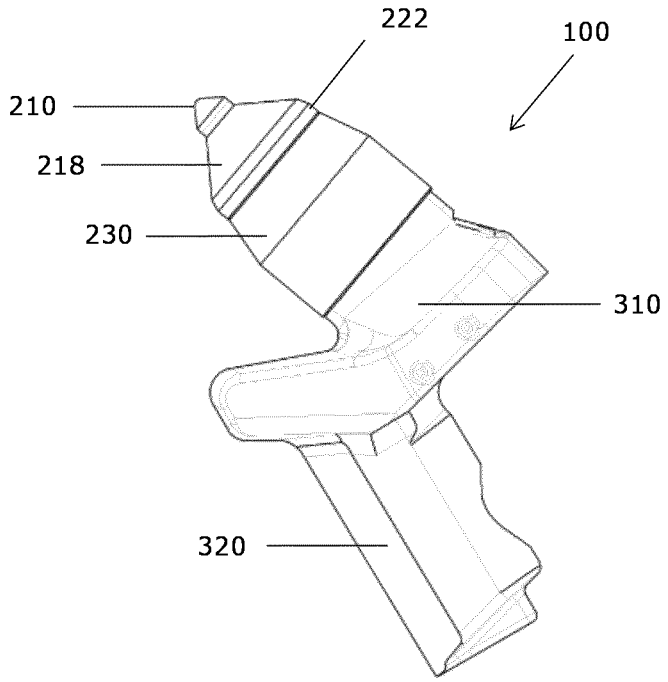
FIG. 1F shows a schematic side view of the example pick tool shown in FIG. 1E.
Figure 1G:
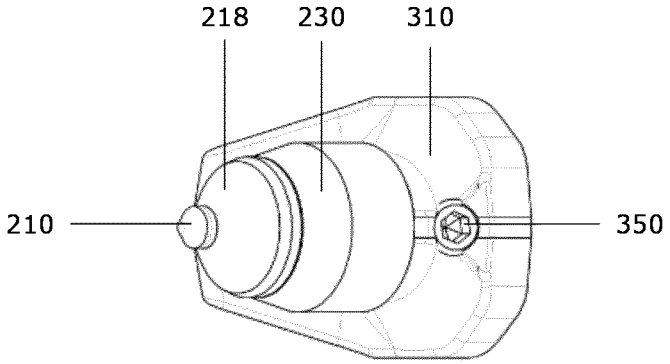
FIG. 1G shows a schematic top view of the example pick tool shown in FIG. 1E.

An example pick tool assembly 100 will be described with reference to FIG. 1A to FIG. 1G. The example pick tool assembly 100 illustrated in FIG. 1A is in the assembled condition and is configured for attachment to a drum for a road milling apparatus (not shown). The forward direction F of movement of the example pick tool in use is indicated schematically. The example pick tool assembly 100 comprises a strike assembly 200, with particular reference to FIG. 1B and FIG. 10, and a holder assembly 300, with particular reference to FIG. 1D. The pick tool assembly 100 is configured such that the strike tip 210 can be non-moveably coupled with the holder assembly 300 in any of a plurality of orientations about a rotational symmetry axis L relative to the holder assembly 300. The number of possible orientations of the strike tip 210 relative to the holder assembly 300 when the pick tool assembly 100 is in the assembled condition is limited to two, at 180 degrees with respect to each other about the symmetry axis L.

In this particular example, the strike assembly 200 comprises a pick insert 220 and an intermediate holder 230 to which the pick insert 220 is attached. The pick insert 220 comprises a strike tip 210 joined to a proximate end of a support body 218 by braze material. The strike tip 210 comprises a polycrystalline diamond (PCD) strike structure 208 joined to a cemented carbide substrate 215 in the same process in which the PCD material of the strike structure 208 was formed by sintering together a plurality of diamond grains onto the substrate 215 at an ultra-high pressure of at least about 5.5 gigapascals. The support body 218 consists of cemented carbide material of a substantially more abrasion resistant grade than the cemented carbide material comprised in the substrate 215. The support body 218 comprises a shaft 225 that is shrink fitted within a bore provided at a proximate end of the intermediate holder 230. The support body 218 and therefore the strike tip 210 are thus non-rotationally attached to the intermediate holder 230. The intermediate holder 230 comprises a coupler shaft 240 for attaching the intermediate holder 230 to the holder assembly 300.

In this particular example, the support body 218 comprises a head portion 222 that is external to the bore of the intermediate holder 230 in the assembled condition, in which the shaft 225 of the support body 218 is inserted and shrink fitted in the bore. The head portion 222 has a generally frustoconical shape, comprising a flat proximate end surface to which the substrate 215 of the strike tip 210 is bonded by means of braze material, and a conical surface extending from the flat proximate end. The outermost lateral diameter of the head portion 222 is greater than the diameter of the bore (and of the shaft 225), and the base of the head portion 222 abuts the proximate end surface of the intermediate holder 230 surrounding the bore. In this particular example, the base of the head portion 222 of the support body 218 extends to the outermost diameter of the intermediate holder 230 at its proximate end, all the way around the bore (and the shaft 225). In this particular example, the support body 218 comprises cemented tungsten carbide material and the intermediate holder comprises steel. The head portion 222 of the support body 218 may provide a degree of protection of the intermediate holder 230 against wear in use, since the cemented carbide material of which the support body 218 consists will have substantially higher resistance to abrasive wear than the steel of which the intermediate holder 230 consists. The cemented carbide material comprised in the support body 218 may have Rockwell hardness of about 90 HRa and transverse rupture strength of about 2,500 MPa, and the tungsten carbide grains comprised in the cemented carbide material may have a mean size of about 2 microns.

In this particular example, the holder assembly 300 comprises a steel holder member 310 and a securement member comprising a set screw 350 (which may be a blind set screw, also called a grub screw), for securing the coupler shaft 240 of the intermediate holder 230. The holder member 310 includes a bore at a proximate end for accommodating the coupler shaft 240 of the intermediate holder 230, and a shaft 320 at a distal end for attaching the holder assembly 300 to a base (not shown) attached to the drum (not shown). The set screw 350 can be accommodated by a threaded aperture provided in a side wall of the bore of the holder member 310, arranged at an angle with respect to the inner surface of the bore.

In this particular example, the coupler shaft 240 is generally cylindrical in shape and includes a pair of opposite engagement areas 245-*i*, 245-*ii* disposed opposite each other on the side of the coupler shaft 240, depending inwards from the cylindrical side of the coupler shaft 240, at angles of equal magnitude but opposite direction with respect to the cylindrical side. The engagement areas 245-*i*, 245-*ii* are arranged such that a flat end of the set screw 350 can impinge on either one of them when coupler shaft 240 is inserted in the bore, depending on the orientation of the intermediate holder 230 with respect to the holder member 310, such that the end of the set screw 350 lies flush against the engagement area 245-*i* or 245-*ii* and prevents the coupler shaft 240 from rotating within the bore of the holder member 315. As shown in FIG. 10, intermediate areas 247 of the side of the coupler shaft 240 located between the engagement areas 245-*i*, 245-*ii* are curved. The coupler shaft 240 cannot be adequately engaged and secured by the set screw 350 when the coupler shaft 240 is arranged in the bore of the holder member 310 such that a cylindrical area 247 between the engagement areas 245-*i*, 245-*ii* is exposed to the set screw 350.

Figure 2:
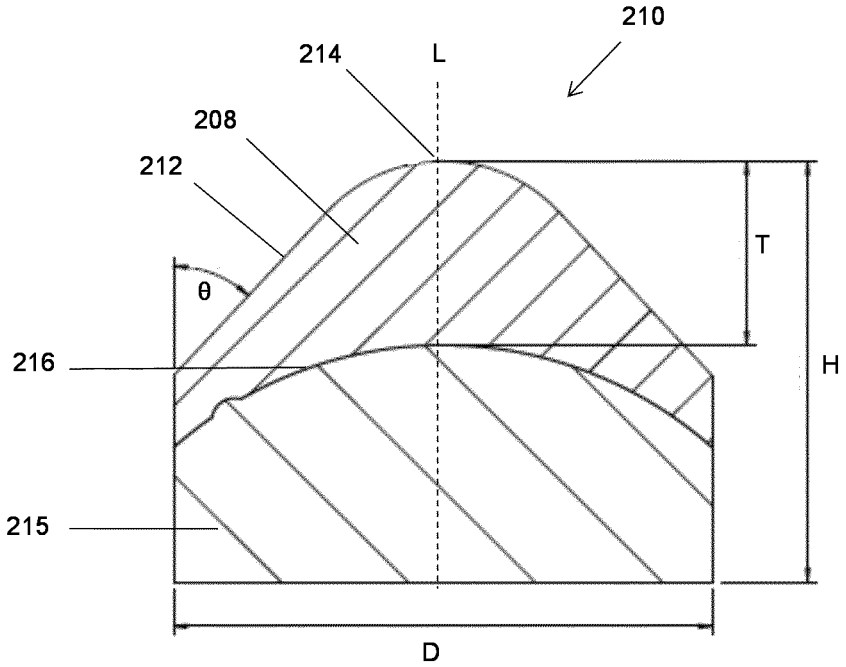
FIG. 2 shows a schematic cross section view through the apex of an example strike tip.

With reference to FIG. 2, a particular example strike tip 210 may consist of a PCD strike structure 208 formed joined to a cemented carbide substrate 215 at a boundary 216. The strike structure 208 has a strike surface 212 in the general form of a blunted cone, including a spherically blunted cone apex 214. The apex 214 has a radius of curvature in a longitudinal plane of about 3 millimeters, the longitudinal plane being parallel to a symmetry axis L passing through the apex 214 and the boundary 216 opposite the apex 214. The strike surface 212 has a conical area inclined at an angle θ of about 43 degrees with respect to a plane tangent to a peripheral side surface of the strike tip 210. The boundary 216 is generally dome-shaped and defined by a spherically convex proximate end of the substrate 215 having a radius of curvature in the longitudinal plane of about 9 millimeters. The thickness T of the PCD strike structure 208 between the apex 214 and the boundary 216 opposite the apex 214 is about 4 millimeters. The overall height H of the strike tip 210 between the apex 214 and a distal end of the substrate 215 opposite the apex 214 is about 9.4 millimeters. The volume of the PCD strike structure 208 is about 280.7 cubic millimeters and the volume of the substrate is about 476 cubic millimeters. In other example arrangements, the volume of the PCD strike structure 208 may be at least 70 percent and at most 150 percent of the volume of the substrate 215. The PCD material may comprise about 82 weight percent substantially inter-gown diamond grains and about 18 weight percent filler material disposed in the interstitial regions between the diamond grains, the filler material comprising cobalt. The diamond grains may have a multi-modal size distribution and a mean size of about 20 microns, in this example.

In this particular example, the substrate 215 may comprise cobalt-cemented tungsten carbide material comprising about 92 weight percent tungsten carbide (WC) grains and about 8 weight percent cobalt (Co). The hardness of the cemented carbide material is about 88.7 HRa (Rockwell hardness scale A), the transverse rupture strength is about 2,800 MPa (megapascals), the fracture toughness is about 14.6 MPa (megapascals) and the Young's modulus is about 600 MPa (megapascals).

Figure 3A:
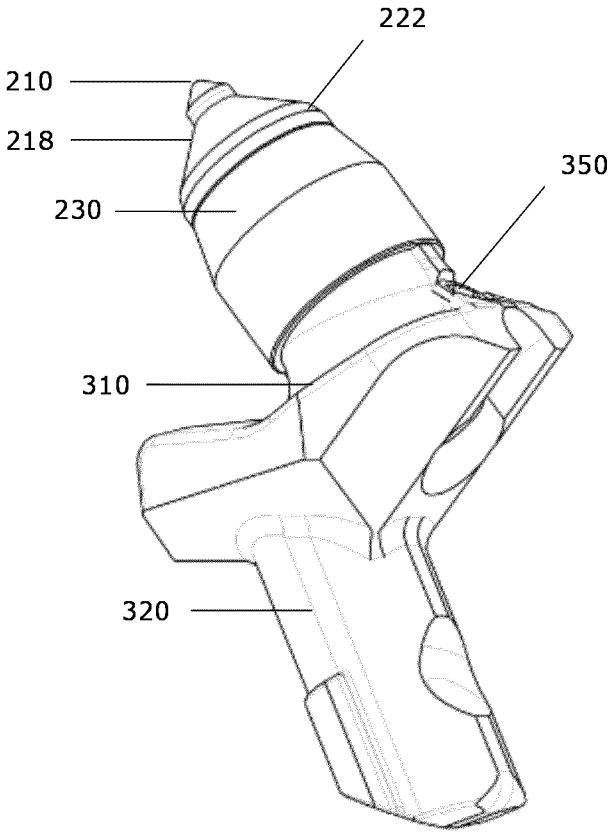
FIG. 3A shows a schematic perspective view of an example pick tool.
Figure 3B:
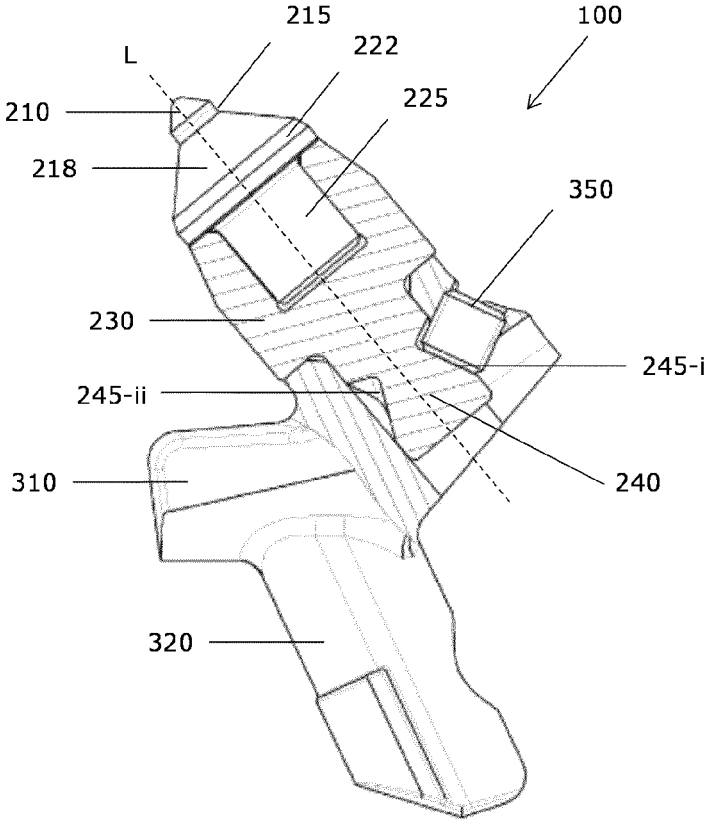
FIG. 3B shows a schematic partly cut-away side view of the example pick tool shown in FIG. 3A.

A further example pick tool assembly 100 is illustrated in FIG. 3A and FIG. 3B, in which the reference numbers refer to the same general features as in the example described above with reference to FIG. 1A to FIG. 1G.

Figure 4:
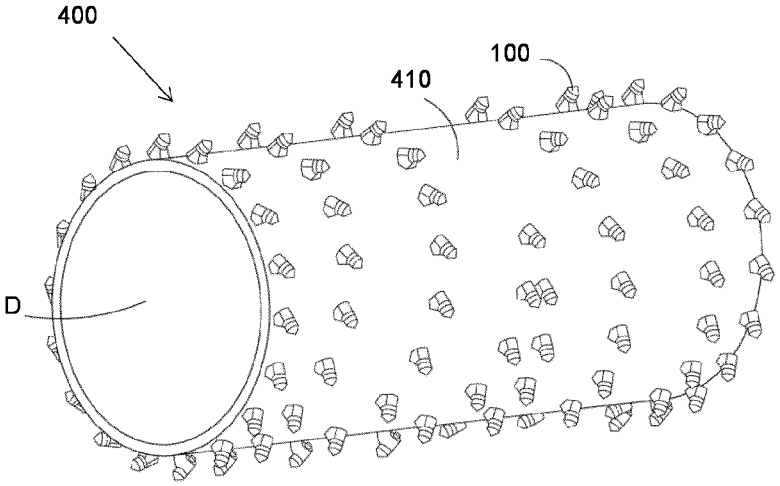
FIG. 4 shows a schematic perspective view of a drum apparatus for road milling.

In use, a pick tool 100 will be driven by a drive apparatus in a forward direction, the strike structure 208 being struck against a body to be degraded with sufficient force to break material comprised in the body. For example, an apparatus 400 for road milling is illustrated in FIG. 4, in which a plurality of pick tools 100 are be non-moveably attached to a drum 410, which can be mounted on a vehicle (not shown) and driven to rotate about a cylindrical axis D of the drum 410. As the drum rotates, the picks 100 can be driven to strike road pavement, which may comprise asphalt or concrete, thus breaking up the pavement.

Various components of each pick 100 will likely become abraded in use, resulting in some change in the shape of the components. In particular, the front-facing and side portions of the intermediate holder 230, the support body 218 and the strike tip 210 will tend to become worn in use, with a substantial amount of material potentially being removed from at least some of these components. For example, in arrangements where the outer periphery of the intermediate holder 230 initially presents a circular lateral cross section (i.e. when viewed from above, along the symmetry axis L), it may present a non-circular (or part circular, part elliptical or hyperbolic) cross section after substantial use, since material would likely be worn away from its front and side portions, but not from the backward-facing portion. Re-orientation of the strike assembly 200 relative to the holder member 310 by less than about 160 degrees would likely present a substantially asymmetric shape to the body being degraded (i.e. when viewed from the front) and the effectiveness and further working life of the pick tool would likely be reduced. However, the strike assembly 200 may be re-oriented with respect to the holder member 310 by more than about 160 degrees and less than about 200 degrees, and the effective working like of the pick tool 100 thus substantially extended.

Strike tips comprising super-hard material, particularly PCD material, are likely to wear in use at a substantially lower rate than other components. Consequently, it may not be necessary for the strike tip to be allowed to rotate in use in order to even out the wear over the surface of the strike tip. Non-rotating picks may have the aspect of wearing in a more predictable way than rotating picks, potentially because the latter my tend to become less rotatable with use due to the accumulation of debris between the pick shank and the holder.

In particular, PCD or PCBN material is generally substantially more resistant to abrasive wear than cemented carbide material, which is generally more abrasion resistant than steel. For this reason, it may be desirable for high performance pick tools to comprise a super-hard strike tip joined to a cemented carbide support body, which may be attached to a steel holder. In use, the cemented carbide support body is likely to undergo abrasive wear at a substantially higher rate than the strike tip, the leading surface of which (i.e. the forward-facing surface) is likely to undergo some abrasive wear. In particular, cemented carbide material (comprised in the substrate or support body, for example) in front of the strike structure (in relation to a forward direction of movement of the strike structure in use) and on either side of the strike structure is likely to be substantially abraded in use long before the end of the useful life of the strike tip (which may ultimately occur by fracture of the strike structure). In some applications, the useful life of a pick tool may be terminated by the formation and propagation of cracks in a region of the support body behind the strike tip (in relation to the direction of movement in use) rather than to the abrasion of front and or side regions of the support body. While wishing not to be bound by a particular theory, such cracks may arise as a result of repeated impacts of the pick body in use, each impact likely cycling the support body through compressive and tensile stress states.

The useful life of the pick tool can therefore be substantially extended, even doubled in some applications, if the strike assembly comprising the strike structure and the support body is re-oriented with respect to the holder such that the trailing surface of the strike tip will become the leading surface and the rearward-facing portion of the support body will become forward-facing, in relation to the direction of movement of the strike structure in use. This will likely involve detaching the strike assembly from the holder, rotating it relative to the holder by at least about 160 degrees and at most about 200 degrees and then reattaching it to the holder for further use. Various example configurations of pick tool assemblies may permit the extension of the useful life with various re-orientations within the range of about 160 degrees to about 200 degrees. In general, it may be expected that re-orientation of the strike tip by at least about 170 degrees and at most about 190 degrees, or approximately 180 degrees may provide even more substantial extension of the useful life of the pick tool. Owing to the directional nature of the abrasive wear, re-orientation of the strike tip at an angle less than 160 degrees or greater than 200 degrees is not expected to provide substantial extension of the working life.

Pick tool assemblies configured such that the strike assembly is limited to two orientations relative to the holder assembly are likely to have greater strength than assemblies configured to permit more than two orientations, since design features allowing for multiple orientations may be expected to weaken the pick tool unless compensating features to strengthen the tool are introduced. Such compensating features will likely increase the complexity and cost of the tool. Therefore, since there is likely to be little or no benefit from providing for more than two generally opposite orientations, disclosed pick tool assemblies have the aspect of achieving a balance between the possibility of extending the useful life of the tool by means of re-orienting the strike tip and components to which it is attached, while ensuring that the design complexity is relatively low and the overall strength of the tool is sufficiently high to sustain the extended tool life made possible by re-orientation of the strike tip.

Certain terms as used in this disclosure are briefly explained below.

Synthetic and natural diamond, polycrystalline diamond (PCD), cubic boron nitride (cBN) and polycrystalline cBN (PCBN) material are examples of superhard materials. As used herein, synthetic diamond, which is also called man-made diamond, is diamond material that has been manufactured. As used herein, polycrystalline diamond (PCD) material comprises an aggregation of a plurality of diamond grains, a substantial portion of which are directly inter-bonded with each other and in which the content of diamond is at least about 80 volume percent of the PCD material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains.

As used herein, PCBN material comprises grains of cubic boron nitride (cBN) dispersed within a matrix comprising metal or ceramic material.

Other examples of super-hard materials include certain composite materials comprising diamond or cBN grains held together by a matrix comprising ceramic material, such as silicon carbide (SiC), or cemented carbide material, such as Co-bonded WC material (for example, as described in U.S. Pat. Nos. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

As used herein, a pick tool is for the mechanised degradation of a body. The act of degradation may described as breaking up, fragmenting, cutting, milling, planing or removing pieces of material from the body. Examples of bodies that may be degraded by pick tools include road pavement or rock formations, and the body may comprise asphalt, concrete, rock, earth, coal and potash, as just a few examples. A pick tool can be coupled to a drive apparatus for driving the pick against the body to be degraded, in which a strike tip comprised in the pick tool is driven to strike the body.

As used herein, a symmetry axis is a geometrical axis about which a body can be rotated such that the shape of the body, or at least a part of a body, is substantially invariant. In other words, the appearance of a body, or relevant part of the body will remain substantially the same after the rotation about the symmetry axis through at least one angle of rotation. In a cylindrical coordinate system, angles of rotation of a body in a plane perpendicular to the rotational symmetry axis, about which the body is rotated, may be referred to as azimuthal angles (this being the azimuthal coordinate). A body or part of a body may be said to have n-fold rotational symmetry about the symmetry axis if rotation of the body by the angle $\pi/n$ (pi divided by n) radians leaves the appearance of the body or relevant part of the body invariant.

The invention claimed is:

1. A pick tool assembly for road milling or mining, comprising:

a strike tip;

a holder; and a reversible attachment mechanism for coupling the strike tip to the holder, in which the strike tip comprises polycrystalline diamond (PCD) material, a boundary of which is a strike surface including an apex, the apex defining a radius of curvature in a longitudinal plane extending through the apex and a distal end of the strike tip opposite the apex, parallel to a symmetry axis through the apex, the radius of curvature being 1 to 6 mm, configured such that the strike tip can be non-moveably coupled to the holder in two mutually opposite orientations relative to the holder, the orientations being about the symmetry axis, the attachment mechanism limiting the opposite orientations to a single pair of opposite direction on diametrically opposite sides of the symmetry axis, and configured such that the strike tip may be coupled to the holder assembly in either of two and only two mutually opposite orientations.

2. A pick tool assembly as claimed in claim 1, and comprising a drive apparatus, in which the holder and drive apparatus each comprise cooperatively configured respective coupling mechanisms such that the holder can be non-moveably coupled to the drive apparatus.

3. A pick tool assembly as claimed in claim 1, in which the strike surface includes a conical surface at least partly surrounding the apex.

4. A pick tool assembly as claimed in claim 1, comprising a strike assembly and a holder assembly, the strike assembly comprising the strike tip and a coupler member; the holder assembly comprising a holder member for accommodating the coupler member and a securement member for reversibly securing the coupler member to the holder member; the attachment mechanism comprising the coupler member, holder member and securement member, cooperatively configured for non-moveably coupling the strike tip to the holder member in the plurality of mutually opposite orientations.

5. A pick tool assembly as claimed in claim 4, in which the coupler member can be inserted into a bore provided in the holder member, the coupler member and the holder member being cooperatively configured such that the coupler member can be accommodated by the bore and the securement member can reversibly engage the coupler member, operative to secure and to release the coupler member within the bore.

6. A pick tool assembly as claimed in claim 4, in which the coupler member is configured such that the securement member cannot engage the coupler member with sufficient force to prevent rotation of the coupler member within the bore when in use, when the coupler member is oriented within the bore other than at one of a plurality of mutually opposite orientations relative to the holder, the orientations being about a longitudinal symmetry axis of the coupler and at least about 160 degrees azimuthally apart.

7. A pick tool as claimed in claim 4, in which the coupler member comprises a cylindrical side surface and the holder member comprises a bore for accommodating the coupler member; the coupler member comprising a pair of engagement surfaces on opposite sides of the side surface, the coupler member and holder assembly cooperatively configured such that the securement member can impinge on either of the engagement surfaces when the coupler member is inserted in the bore, operative to secure the coupler member within the bore.

8. A pick tool assembly as claimed in claim 4, in which the securement member comprises a set screw accommodated by a threaded aperture provided in the holder member.

9. A pick tool as claimed in claim 4, in which the strike assembly comprises an intermediate holder and a support body; the support body comprising a shaft extending away from an end of the support body to which the strike tip can be joined; the intermediate holder comprising a bore for accommodating the shaft and comprising the coupler member; the shaft and the bore being cooperatively configured such that the shaft can be secured within the bore by means of an interference fit.

10. A pick tool assembly as claimed in claim 9, in which the support body and the intermediate holder are configured such that the support body will shield an external surface area of the intermediate holder in use.

11. A pick tool assembly as claimed in claim 9, in which the support body comprises a head portion from which the shaft extends, configured such that the head portion abuts a proximate end surface of the intermediate holder surrounding the bore when the shaft is inserted in the bore of the intermediate holder.

12. A pick tool assembly as claimed in claim 11, in which the head portion comprises a conical side surface extending away from a flat end surface to which the strike tip is attached, and a base surface opposite the conical surface, the base surface extending over an external surface area of the intermediate holder when the shaft of the support body is inserted into the bore of the intermediate holder.

13. A pick tool assembly as claimed in claim 9, in which the support body comprises cemented tungsten carbide material having Rockwell hardness of at least about 90 HRa (Rockwell hardness scale A) and transverse rupture strength of at least about 2,500 MPa (megapascals).

14. A pick tool assembly as claimed in claim 9, in which the support body comprises cemented tungsten carbide material having magnetic saturation of at least about 7 G.cm3/g (Gauss times cubic centimeter per gram) and at most about 11 G.cm3/g (Gauss times cubic centimeter per gram) and coercivity of at least about 9 kA/m (kiloamperes per meter) and at most about 14 kA/m (kiloamperes per meter).

15. A method of using a pick tool assembly as claimed in claim 1, the method including providing a pick tool assembly in an assembled condition, in which the strike structure is arranged in a first orientation relative to the holder assembly; fragmenting a body or a plurality of bodies comprising a road pavement or a rock formation, by repeatedly striking the strike structure against the body or bodies; changing the orientation of the strike structure such that it is arranged in a second orientation relative to the holder assembly, the first and second orientations being in opposite directions, and further fragmenting a body or a plurality of bodies by repeatedly striking the strike structure against the body or bodies.

16. A method as claimed in claim 15, including striking the body or bodies a first number of strikes when the strike structure is in the first orientation and striking a body or bodies a second number of strikes when the strike structure is in the second orientation, in which the second number of strikes is at least 50 percent the first number of strikes.

* * * * *